US009761943B2

(12) United States Patent
Yang

(10) Patent No.: US 9,761,943 B2
(45) Date of Patent: Sep. 12, 2017

(54) ANTENNA STRUCTURE

(71) Applicant: Acer Incorporated, New Taipei (TW)

(72) Inventor: Chung-Wen Yang, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 30 days.

(21) Appl. No.: 14/828,797

(22) Filed: Aug. 18, 2015

(65) Prior Publication Data

US 2016/0359231 A1 Dec. 8, 2016

(30) Foreign Application Priority Data

Jun. 3, 2015 (TW) ..... 104117909 A

(51) Int. Cl.

| | |
|---|---|
| ***H01Q 1/48*** | (2006.01) |
| ***H01Q 5/371*** | (2015.01) |
| ***H01Q 1/24*** | (2006.01) |
| ***H01Q 7/00*** | (2006.01) |
| ***H01Q 5/40*** | (2015.01) |

(52) U.S. Cl.

CPC ..... *H01Q 5/371* (2015.01); *H01Q 1/243* (2013.01); *H01Q 1/48* (2013.01); *H01Q 5/40* (2015.01); *H01Q 7/00* (2013.01)

(58) Field of Classification Search

CPC ..... H01Q 5/371; H01Q 1/38; H01Q 5/307; H01Q 1/243

USPC ..... 343/845, 700 MS, 720, 702

See application file for complete search history.

(56) References Cited

U.S. PATENT DOCUMENTS

2006/0097918 A1 5/2006 Oshiyama et al.
2012/0050121 A1* 3/2012 Kim ..... H01Q 1/243 343/745

FOREIGN PATENT DOCUMENTS

| | | |
|---|---|---|
| EP | 2 048 739 | 4/2009 |
| TW | I329391 | 8/2010 |
| TW | I355777 | 1/2012 |
| TW | I466381 | 12/2014 |

OTHER PUBLICATIONS

Chinese language office action dated May 20, 2016, issued in application No. TW 104117909.

European Search Report dated Oct. 18, 2016, issued in application No. 15191180.7-1811.

* cited by examiner

*Primary Examiner* — Dameon E Levi
*Assistant Examiner* — Collin Dawkins
(74) *Attorney, Agent, or Firm* — McClure, Qualey & Rodack, LLP

(57) ABSTRACT

An antenna structure includes a ground element, a first radiation branch, a first ground branch, a second radiation branch, and a second ground branch. A first end of the first radiation branch is coupled to a signal source. A first end of the first ground branch is coupled to the ground element. A second end of the first ground branch is coupled to a second end of the first radiation branch. A first end of the second radiation branch is coupled to the second end of the first radiation branch. A first end of the second ground branch is coupled to the ground element. A second end of the second ground branch is coupled to a second end of the second radiation branch.

8 Claims, 8 Drawing Sheets

ANTENNA STRUCTURE

CROSS REFERENCE TO RELATED APPLICATIONS

This application claims priority of Taiwan Patent Application No. 104117909 filed on Jun. 3, 2015, the entirety of which is incorporated by reference herein.

BACKGROUND OF THE INVENTION

Field of the Invention

The disclosure generally relates to an antenna structure, and more particularly, to a small-size antenna structure.

Description of the Related Art

With advancements in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

An antenna is indispensable in a mobile device supporting wireless communication. However, since a mobile device often has limited interior space, there is not sufficient area for accommodating the required antenna element. Accordingly, it becomes a critical challenge for antenna designers to design a novel antenna with a small size and wideband characteristics.

BRIEF SUMMARY OF THE INVENTION

In a preferred embodiment, the invention is directed to an antenna structure including a ground element, a first radiation branch, a first ground branch, a second radiation branch, and a second ground branch. A first end of the first radiation branch is coupled to a signal source. A first end of the first ground branch is coupled to the ground element. A second end of the first ground branch is coupled to a second end of the first radiation branch. A first end of the second radiation branch is coupled to the second end of the first radiation branch. A first end of the second ground branch is coupled to the ground element. A second end of the second ground branch is coupled to a second end of the second radiation branch.

In some embodiments, the antenna structure includes a first loop structure and a second loop structure.

In some embodiments, the first loop structure is formed by the first radiation branch, the second radiation branch, the second ground branch, and the ground element.

In some embodiments, the second loop structure is formed by the first radiation branch, the first ground branch, and the ground element.

In some embodiments, a total length of the first loop structure is longer than a total length of the second loop structure.

In some embodiments, the first loop structure is excited to generate a first frequency band, and the second loop structure is excited to generate a second frequency band. The first frequency band is from about 2400 MHz to about 2500 MHz, and the second frequency band is from about 5150 MHz to about 5850 MHz.

In some embodiments, the first radiation branch has a U-shape, and each of the first ground branch, the second radiation branch, and the second ground branch has a straight-line shape.

In some embodiments, the antenna structure further includes an extension branch. The extension branch is coupled to the second end of the second radiation branch and the second end of the second ground branch.

In some embodiments, the antenna structure further includes a parasitic branch. The parasitic branch is coupled to the ground element, and is disposed adjacent to the first radiation branch.

In some embodiments, the antenna structure further includes a feeding tuning branch. The feeding tuning branch is coupled to an initial portion of the first radiation branch, and is surrounded by the first radiation branch.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the foregoing and other purposes, features and advantages of the invention, the embodiments and figures of the invention will be described in detail as follows.

Figure 1:
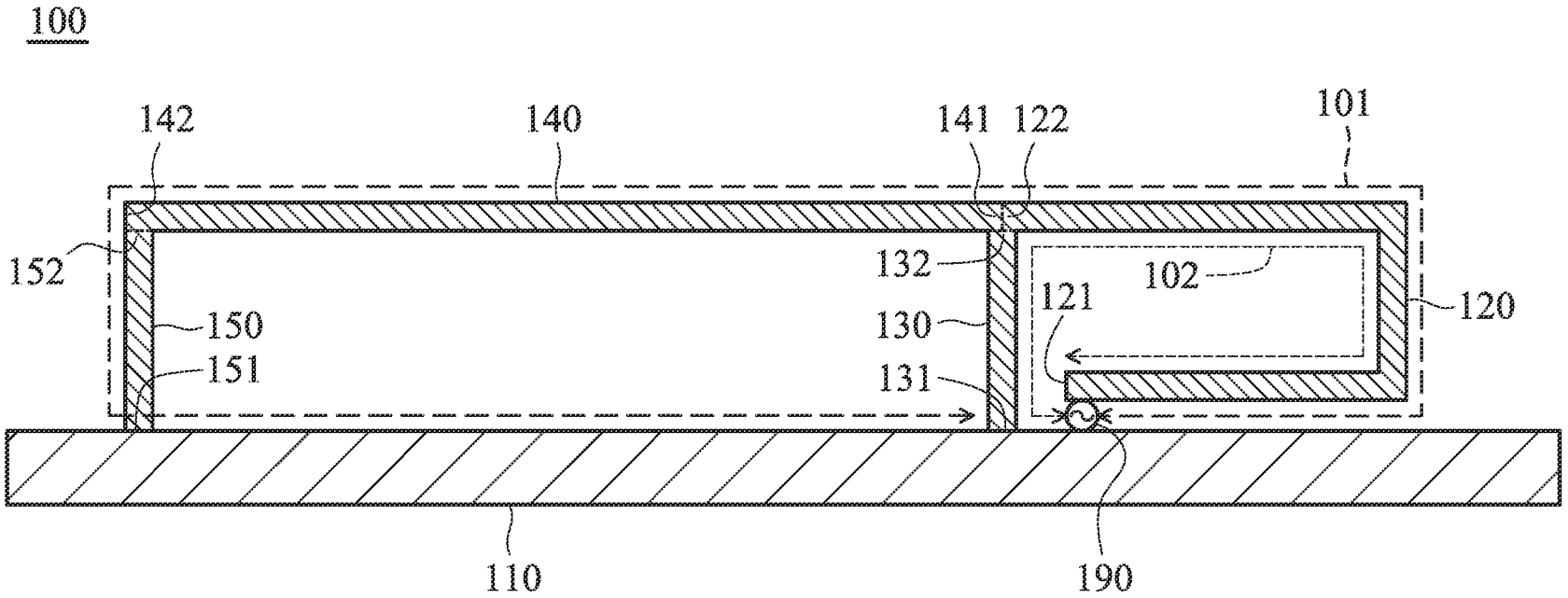
FIG. 1 is a diagram of an antenna structure according to an embodiment of the invention.

FIG. 1 is a diagram of an antenna structure 100 according to an embodiment of the invention. The antenna structure 100 may be applied in a mobile device, such as a smartphone, a tablet computer, or a notebook computer. As shown in FIG. 1, the antenna structure 100 includes a ground element 110, a first radiation branch 120, a first ground branch 130, a second radiation branch 140, and a second ground branch 150. The ground element 110 may be a ground metal plane of a mobile device. The first radiation branch 120, the first ground branch 130, the second radiation branch 140, and the second ground branch 150 may be made of conductive materials, such as copper, silver, aluminum, iron, or their alloys. The antenna structure 100 may be disposed on a dielectric substrate (not shown), such as a system circuit board or an FR4 (Flame Retardant 4) substrate.

The first radiation branch 120 may substantially have a U-shape. The first radiation branch 120 has a first end 121 and a second end 122. The first end 121 of the first radiation branch 120 is coupled to a signal source 190. The signal source 190 may be an RF (Radio Frequency) module of a mobile device, and may be configured to excite the antenna structure 100. The first ground branch 130 may substantially have a straight-line shape, and may be substantially perpendicular to an edge of the ground element 110. The first ground branch 130 has a first end 131 and a second end 132. The first end 131 of the first ground branch 130 is coupled to the ground element 110. The second end 132 of the first ground branch 130 is coupled to the second end 122 of the first radiation branch 120. The second radiation branch 140 may substantially have a straight-line shape, and may be substantially parallel to the edge of the ground element 110. The second radiation branch 140 has a first end 141 and a second end 142. The first end 141 of the second radiation branch 140 is coupled to the second end 122 of the first radiation branch 120 and the second end 132 of the first ground branch 130. The second ground branch 150 may substantially have a straight-line shape, and may be substantially perpendicular to the edge of the ground element 110. The second ground branch 150 has a first end 151 and a second end 152. The first end 151 of the second ground branch 150 is coupled to the ground element 110. The second end 152 of the second ground branch 150 is coupled to the second end 142 of the second radiation branch 140.

As to the antenna theory, the antenna structure 100 includes a first loop structure 101 and a second loop structure 102. The first loop structure 101 is formed by the first radiation branch 120, the second radiation branch 140, the second ground branch 150, and a portion of the ground element 110. The second loop structure 102 is formed by the first radiation branch 120, the first ground branch 130, and another portion the ground element 110. The total length of the first loop structure 101 is longer than the total length of the second loop structure 102. When the antenna structure 100 is excited, the first loop structure 101 is excited to generate a first frequency band, and the second loop structure 102 is excited to generate a second frequency band. The first frequency band is from about 2400 MHz to about 2500 MHz, and the second frequency band is from about 5150 MHz to about 5850 MHz.

To be brief, the antenna structure 100 of the invention is considered as a variation of a loop antenna. The difference from the conventional loop antenna is that the proposed antenna structure 100 has two combined loop structures respectively coupled to two different ground points on the ground element 110. One loop structure is excited to generate a low-frequency resonant mode, and another loop structure is excited to generate a high-frequency resonant mode. Since the two loop structures share portions of resonant paths (e.g., the resonant path of the first radiation branch 120), the total area of the antenna structure 100 can be reduced further. According to practical measurements, the proposed antenna structure 100 has a length of about 55 mm and a width of about 11 mm, and its antenna efficiency can achieve −4 dBi in 2.4 GHz/5 GHz frequency bands. Therefore, the invention has the advantages of minimizing the antenna size, maintaining the antenna efficiency, and widening the antenna bandwidth, and it is suitable for application in a variety of small-size mobile communication devices.

Figure 2:
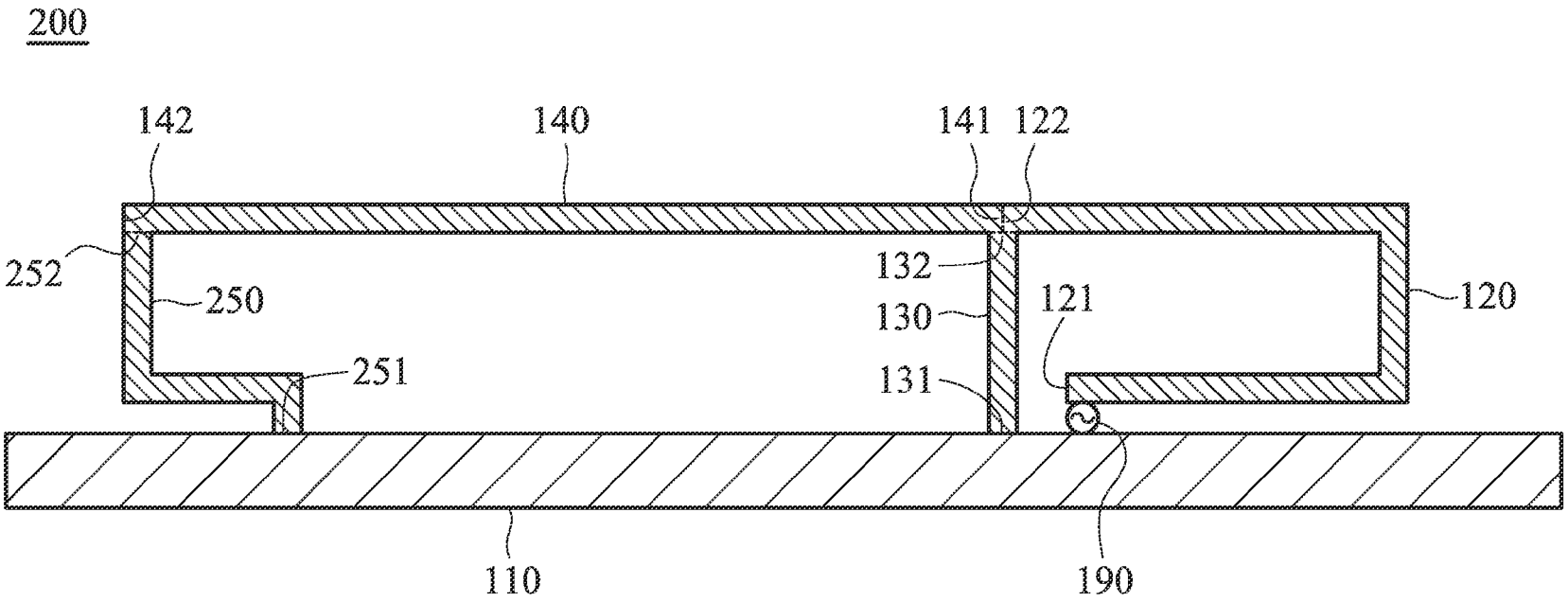
FIG. 2 is a diagram of an antenna structure according to an embodiment of the invention.

FIG. 2 is a diagram of an antenna structure 200 according to an embodiment of the invention. FIG. 2 is similar to FIG. 1. In the embodiment of FIG. 2, a second ground branch 250 of the antenna structure 200 has a meandering structure. The meandering structure may substantially have an N-shape or a W-shape. The design of the meandering second ground branch 250 can further reduce the total area of the antenna structure 200, and therefore the antenna structure 200 can be applied to small-size devices. Other features of the antenna structure 200 of FIG. 2 are similar to those of the antenna structure 100 of FIG. 1. Accordingly, the two embodiments can achieve similar levels of performance.

Figure 3:
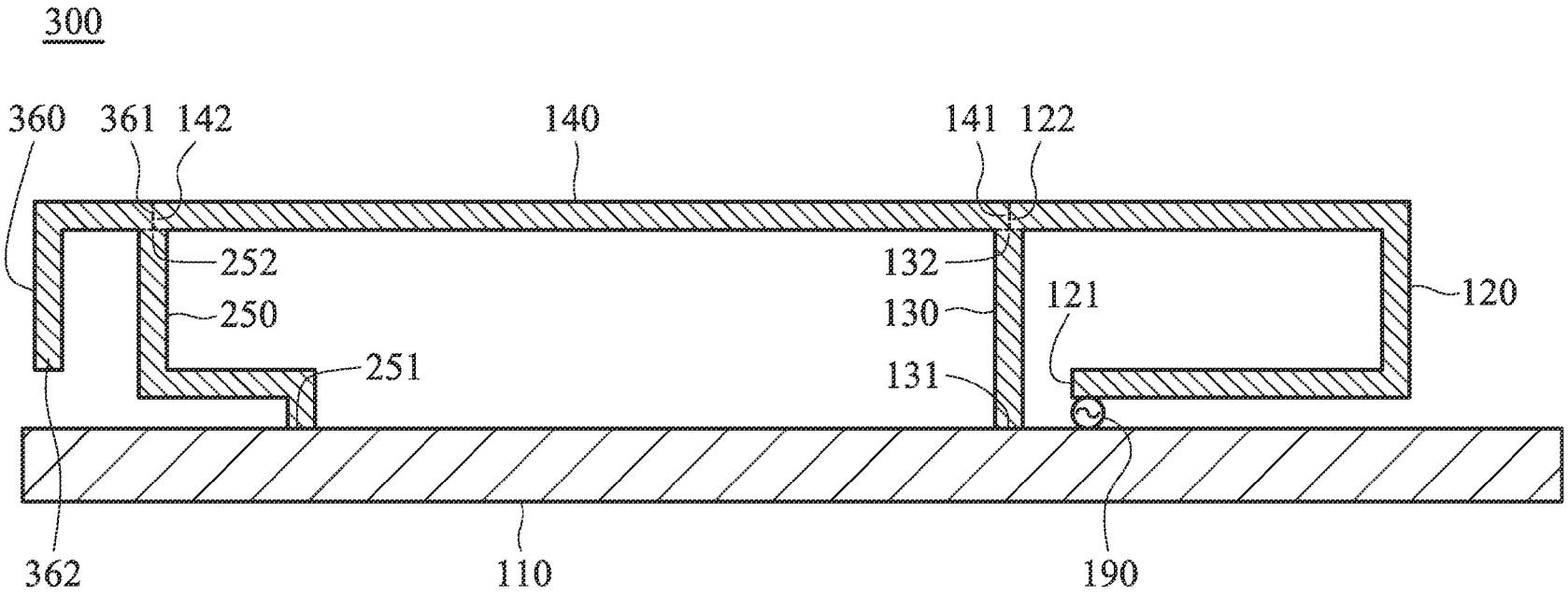
FIG. 3 is a diagram of an antenna structure according to an embodiment of the invention.

FIG. 3 is a diagram of an antenna structure 300 according to an embodiment of the invention. FIG. 3 is similar to FIG. 2. In the embodiment of FIG. 3, the antenna structure 300 further includes an extension branch 360. The extension branch 360 may substantially have an L-shape. The extension branch 360 has a first end 361 and a second end 362. The first end 361 of the extension branch 360 is coupled to the second end 142 of the second radiation branch 140 and a second end 252 of the second ground branch 250. The second end 362 of the extension branch 360 is open. The extension branch 360 is configured to widen the bandwidth of the first frequency band (low-frequency band) of the antenna structure 300. Other features of the antenna structure 300 of FIG. 3 are similar to those of the antenna structure 200 of FIG. 2. Accordingly, the two embodiments can achieve similar levels of performance.

Figure 4:
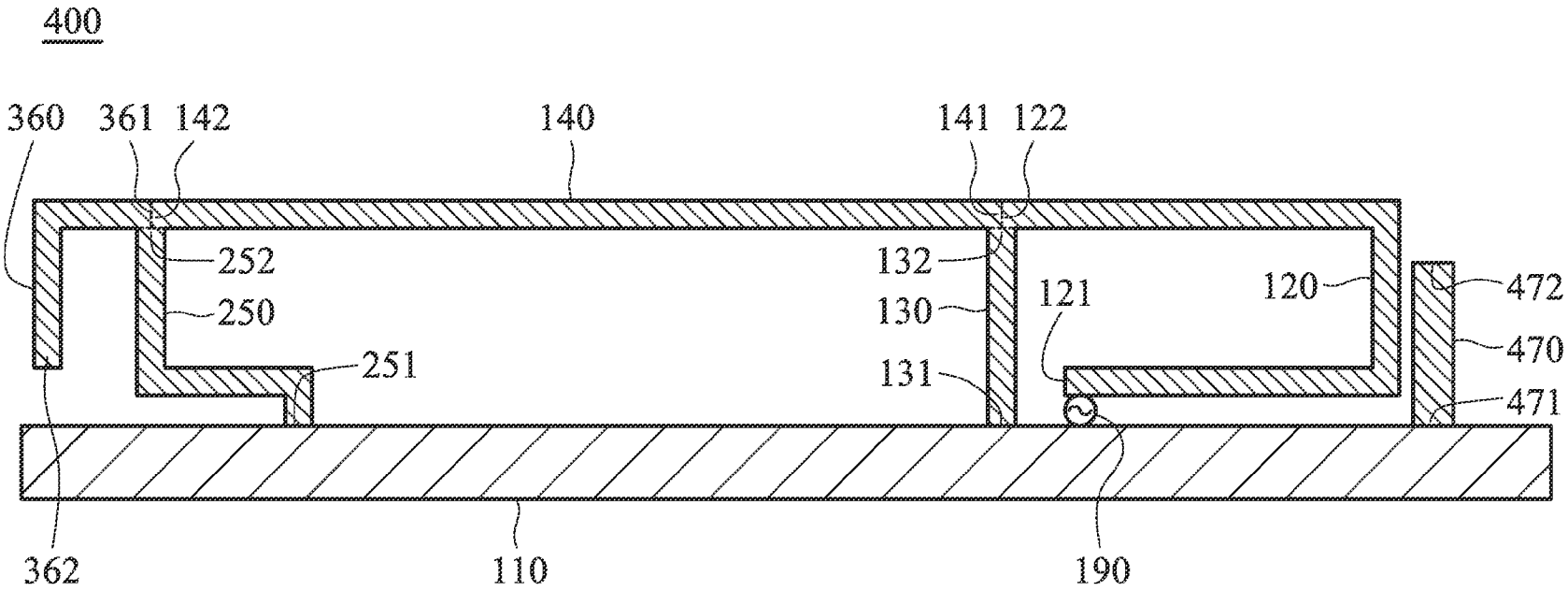
FIG. 4 is a diagram of an antenna structure according to an embodiment of the invention.

FIG. 4 is a diagram of an antenna structure 400 according to an embodiment of the invention. FIG. 4 is similar to FIG. 3. In the embodiment of FIG. 4, the antenna structure 400 further includes a parasitic branch 470. The parasitic branch 470 may substantially have a straight-line shape, and may be substantially perpendicular to the edge of the ground element 110. The parasitic branch 470 has a first end 471 and a second end 472. The first end 471 of the parasitic branch 470 is coupled to the ground element 110. The second end 472 of the parasitic branch 470 is open. The parasitic branch 470 is disposed adjacent to a bent portion of the first radiation branch 120, but is separate from the first radiation branch 120 completely. The parasitic branch 470 is configured to widen the bandwidth of the second frequency band (high-frequency band) of the antenna structure 400. Other features of the antenna structure 400 of FIG. 4 are similar to those of the antenna structure 300 of FIG. 3. Accordingly, the two embodiments can achieve similar levels of performance.

Figure 5:
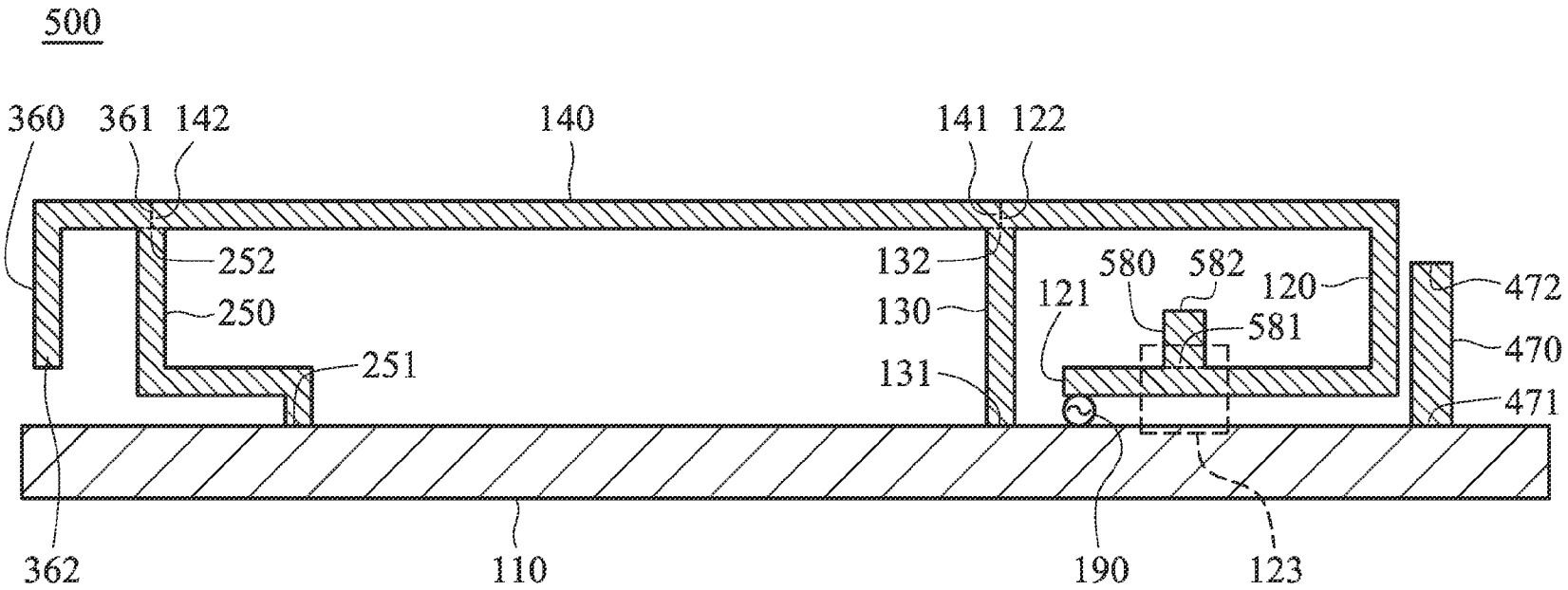
FIG. 5 is a diagram of an antenna structure according to an embodiment of the invention.

FIG. 5 is a diagram of an antenna structure 500 according to an embodiment of the invention. FIG. 5 is similar to FIG. 4. In the embodiment of FIG. 5, the antenna structure 500 further includes a feeding tuning branch 580. The feeding tuning branch 580 may substantially have a rectangular shape, and may be substantially surrounded by the first radiation branch 120. The feeding tuning branch 580 has a first end 581 and a second end 582. The first end 581 of the feeding tuning branch 580 is coupled to an initial portion 123 of the first radiation branch 120. The second end 582 of the feeding tuning branch 580 is open. The feeding tuning branch 580 is configured to tune the feeding impedance matching of the antenna structure 500. Other features of the antenna structure 500 of FIG. 5 are similar to those of the antenna structure 400 of FIG. 4. Accordingly, the two embodiments can achieve similar levels of performance.

Figure 6:
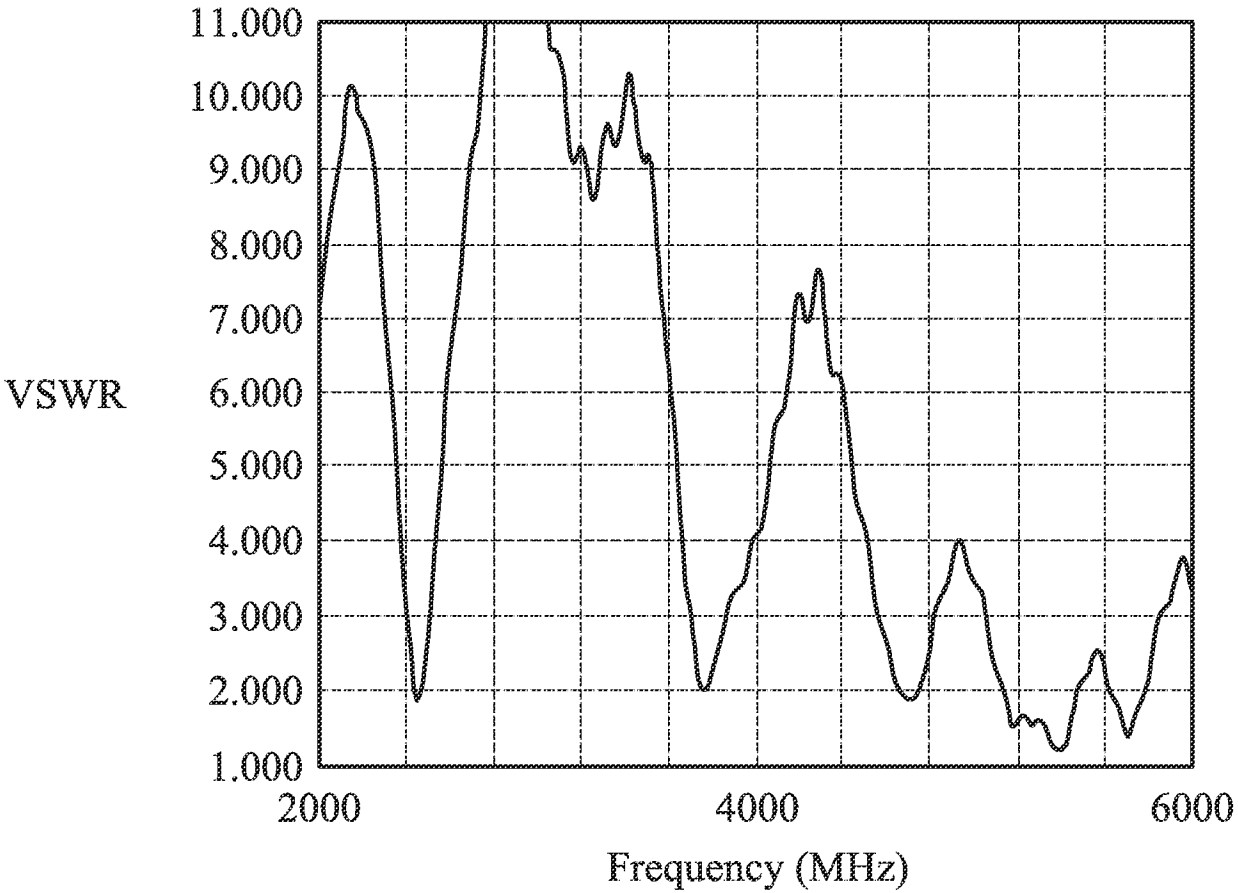
FIG. 6 is a diagram of VSWR (Voltage Standing Wave Ratio) of an antenna structure according to an embodiment of the invention.

FIG. 6 is a diagram of VSWR (Voltage Standing Wave Ratio) of the antenna structure 500 according to an embodiment of the invention. The horizontal axis represents the operation frequency (MHz), and the vertical axis represents the VSWR. According to the criterion of VSWR being equal to 4, the antenna structure 500 covers at least the 2.4 GHz low-frequency band (from about 2400 MHz to about 2500

MHz) and the 5 GHz high-frequency band (from about 5150 MHz to about 5850 MHz). Therefore, the proposed antenna structure can support at least the dual-band operations of Wi-Fi and Bluetooth. The invention has sufficient antenna bandwidth and antenna efficiency, and it can meet the general standard of mobile communication.

Figure 7:
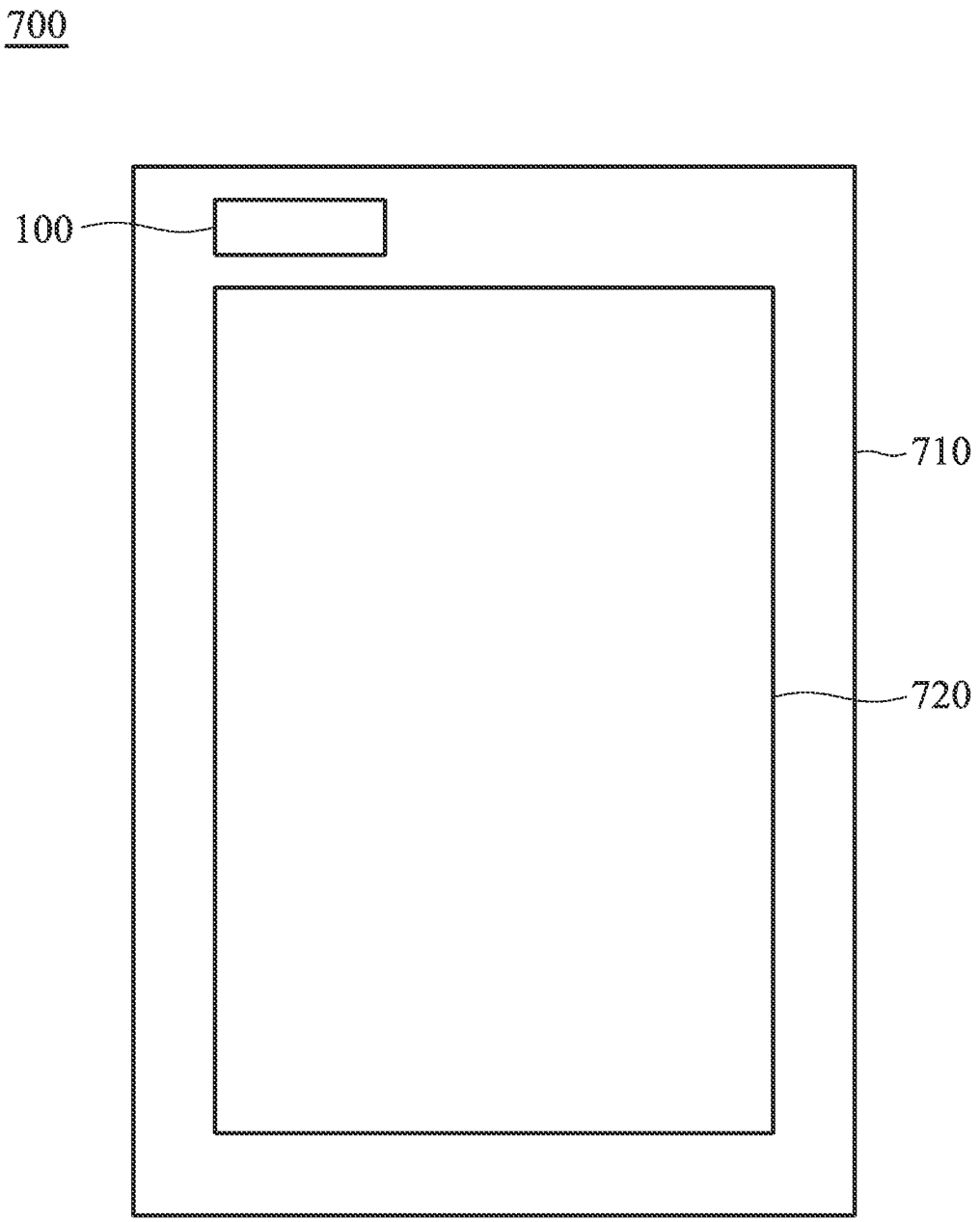
FIG. 7 is a diagram of an electronic device according to an embodiment of the invention.
Figure 8:
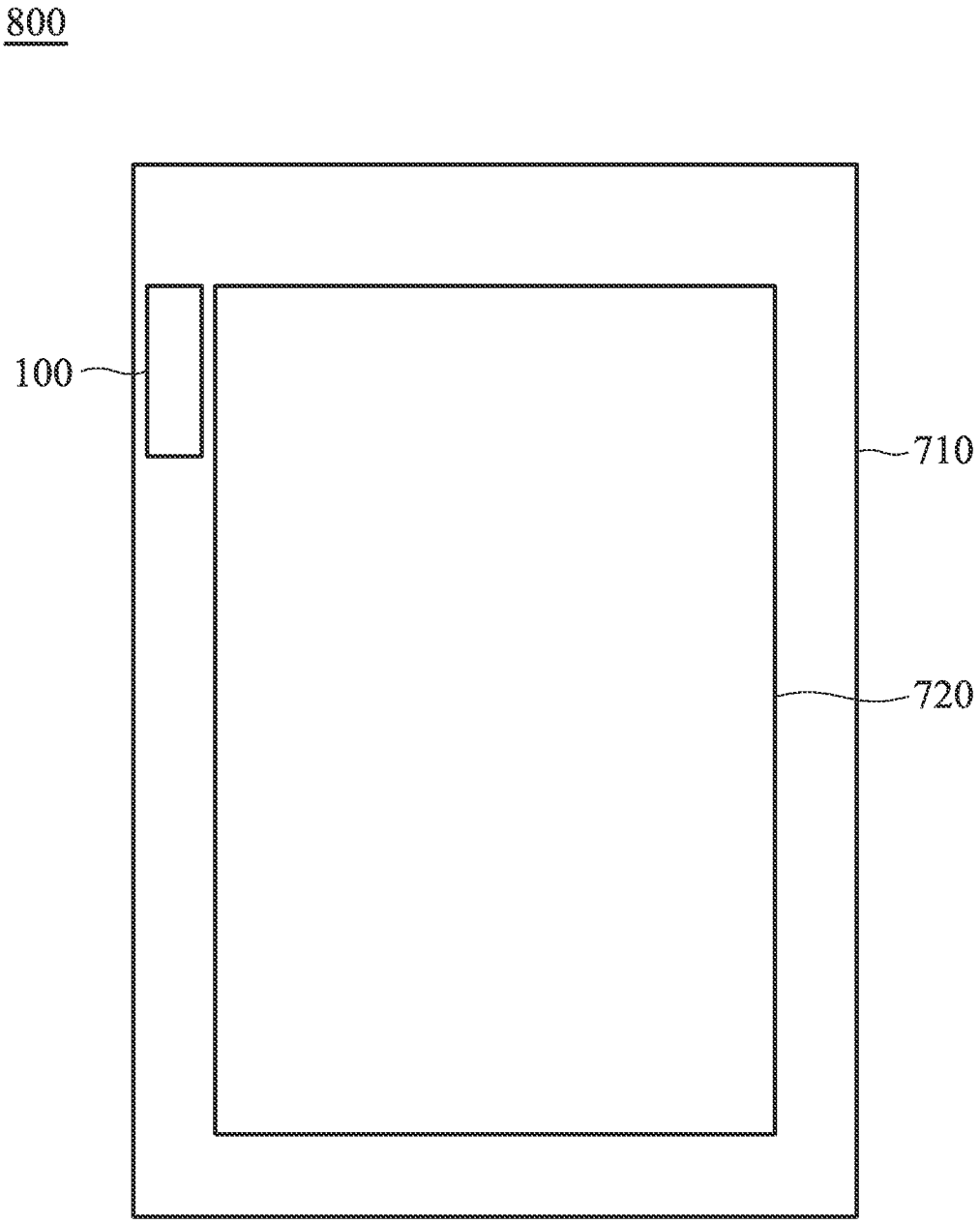
FIG. 8 is a diagram of an electronic device according to an embodiment of the invention.

The antenna structure of the invention can be applied to an electronic device with a metal back cover, but it is not limited thereto. FIG. 7 is a diagram of an electronic device 700 according to an embodiment of the invention. The electronic device 700 may be a mobile communication device, such as a smartphone, a tablet computer, or a notebook computer. In the embodiment of FIG. 7, the electronic device 700 includes a metal back cover 710 and a display device 720. The antenna structure 100 (or 200 or 300 or 400 or 500) may be disposed on the top of the metal back cover 710. The ground element 110 of the antenna structure 100 may be coupled to the metal back cover 710, or may be coupled to a ground plane of a system circuit board (not shown). The ground plane of the system circuit board may be further coupled to the metal back cover 710. The shortest spacing between the antenna structure 100 and the metal back cover 710 may be about 4.5 mm. When the aforementioned spacing increases, the radiation performance of the antenna structure 100 is improved further. The vertical projection of the antenna structure 100 is inside the metal back cover 710. However, the vertical projection of the antenna structure 100 does not overlap with any portion of the display device 720. FIG. 8 is a diagram of an electronic device 800 according to an embodiment of the invention. FIG. 8 is similar to FIG. 7. The difference between the two embodiments is that the relative relationship between the antenna structure 100 and the metal back cover 710 of FIG. 8 is slightly changed. That is, the antenna structure 100 is moved from the top to the left of the metal back cover 710. In alternative embodiments, the antenna structure 100 is moved to the bottom or the right of the metal back cover 710. In other embodiments, the antenna structure 100 is applied to an electronic device with a plastic back cover.

Note that the above element sizes, element shapes, and frequency ranges are not limitations of the invention. An antenna designer can fine-tune these settings or values according to different requirements. It should be understood that the antenna structure of the invention is not limited to the configurations of FIGS. 1-8. The invention may include any one or more features of any one or more embodiments of FIGS. 1-8. In other words, not all of the features displayed in the figures should be implemented in the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

It will be apparent to those skilled in the art that various modifications and variations can be made in the invention. It is intended that the standard and examples be considered as exemplary only, with a true scope of the disclosed embodiments being indicated by the following claims and their equivalents.

What is claimed is:

1. An antenna structure, comprising:

a ground element;

a first radiation branch, having a first end and a second end, wherein the first end of the first radiation branch is coupled to a signal source;

a first ground branch, having a first end and a second end, wherein the first end of the first ground branch is coupled to the ground element, and the second end of the first ground branch is coupled to the second end of the first radiation branch;

a second radiation branch, having a first end and a second end, wherein the first end of the second radiation branch is coupled to the second end of the first radiation branch; and a second ground branch, having a first end and a second end, wherein the first end of the second ground branch is coupled to the ground element, and the second end of the second ground branch is coupled to the second end of the second radiation branch;

wherein the antenna structure comprises a first loop structure and a second loop structure;

wherein the first loop structure is excited to generate a first frequency band, the second loop structure is excited to generate a second frequency band, the first frequency band is from about 2400 MHz to about 2500 MHz, and the second frequency band is from about 5150 MHz to about 5850 MHz.

2. The antenna structure as claimed in claim 1, wherein the first loop structure is formed by the first radiation branch, the second radiation branch, the second ground branch, and the ground element.

3. The antenna structure as claimed in claim 1, wherein the second loop structure is formed by the first radiation branch, the first ground branch, and the ground element.

4. The antenna structure as claimed in claim 1, wherein a total length of the first loop structure is longer than a total length of the second loop structure.

5. An antenna structure, comprising:

a ground element;

a first radiation branch, having a first end and a second end, wherein the first end of the first radiation branch is coupled to a signal source;

a first ground branch, having a first end and a second end, wherein the first end of the first ground branch is coupled to the ground element, and the second end of the first ground branch is coupled to the second end of the first radiation branch;

a second radiation branch, having a first end and a second end, wherein the first end of the second radiation branch is coupled to the second end of the first radiation branch; and a second ground branch, having a first end and a second end, wherein the first end of the second ground branch is coupled to the ground element, and the second end of the second ground branch is coupled to the second end of the second radiation branch;

wherein the first radiation branch has a U-shape, and each of the first ground branch, the second radiation branch, and the second ground branch has a straight-line shape.

6. An antenna structure, comprising:

a ground element;

a first radiation branch, having a first end and a second end, wherein the first end of the first radiation branch is coupled to a signal source;

a first ground branch, having a first end and a second end, wherein the first end of the first ground branch is coupled to the ground element, and the second end of the first ground branch is coupled to the second end of the first radiation branch;

a second radiation branch, having a first end and a second end, wherein the first end of the second radiation branch is coupled to the second end of the first radiation branch;

a second ground branch, having a first end and a second end, wherein the first end of the second ground branch is coupled to the ground element, and the second end of the second ground branch is coupled to the second end of the second radiation branch; and an extension branch, coupled to the second end of the second radiation branch and the second end of the second ground branch.

7. An antenna structure, comprising:

a ground element;

a first radiation branch, having a first end and a second end, wherein the first end of the first radiation branch is coupled to a signal source;

a first ground branch, having a first end and a second end, wherein the first end of the first ground branch is coupled to the ground element, and the second end of the first ground branch is coupled to the second end of the first radiation branch;

a second radiation branch, having a first end and a second end, wherein the first end of the second radiation branch is coupled to the second end of the first radiation branch;

a second ground branch, having a first end and a second end, wherein the first end of the second ground branch is coupled to the ground element, and the second end of the second ground branch is coupled to the second end of the second radiation branch; and a parasitic branch, coupled to the ground element, and disposed adjacent to the first radiation branch.

8. An antenna structure, comprising:

a ground element;

a first radiation branch, having a first end and a second end, wherein the first end of the first radiation branch is coupled to a signal source;

a first ground branch, having a first end and a second end, wherein the first end of the first ground branch is coupled to the ground element, and the second end of the first ground branch is coupled to the second end of the first radiation branch;

a second radiation branch, having a first end and a second end, wherein the first end of the second radiation branch is coupled to the second end of the first radiation branch;

a second ground branch, having a first end and a second end, wherein the first end of the second ground branch is coupled to the ground element, and the second end of the second ground branch is coupled to the second end of the second radiation branch; and a feeding tuning branch, coupled to an initial portion of the first radiation branch, and surrounded by the first radiation branch.

* * * * *